US008372245B2

(12) United States Patent
Jorkama

(10) Patent No.: US 8,372,245 B2
(45) Date of Patent: Feb. 12, 2013

(54) ROLL ASSEMBLY FOR A FIBER-WEB MACHINE AND METHOD OF ATTENUATING VIBRATION OF A FIBER-WEB MACHINE ROLL

(75) Inventor: Marko Jorkama, Porvoo (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 13/257,202

(22) PCT Filed: Feb. 23, 2010

(86) PCT No.: PCT/FI2010/050122

§ 371 (c)(1),
(2), (4) Date: Sep. 16, 2011

(87) PCT Pub. No.: WO2010/106219

PCT Pub. Date: Sep. 23, 2010

(65) Prior Publication Data

US 2012/0000623 A1 Jan. 5, 2012

(30) Foreign Application Priority Data

Mar. 18, 2009 (FI) ..... 20095277

(51) Int. Cl.
*D21F 11/00* (2006.01)

(52) U.S. Cl. ..... 162/198; 162/199; 162/263; 162/289; 242/599

(58) Field of Classification Search ..... 162/198, 162/199, 289, 263, 272; 242/599, 541, 542, 242/534, 66; 29/428
See application file for complete search history.

(56) References Cited

U.S. PATENT DOCUMENTS

| | | | | |
|---|---|---|---|---|
| 3,334,834 | A * | 8/1967 | Davidson et al. | 242/541 |
| 3,902,677 | A * | 9/1975 | Wolf | 242/542 |
| 4,313,577 | A | 2/1982 | Peters | |
| 6,911,117 | B1 | 6/2005 | Karhunen et al. | |
| 7,588,208 | B2 * | 9/2009 | Stitz | 242/534 |
| 7,967,236 | B2 | 6/2011 | Jorkama et al. | |
| 2007/0238597 | A1 | 10/2007 | Michler et al. | |

FOREIGN PATENT DOCUMENTS

| | | | |
|---|---|---|---|
| CA | 2210935 | A1 | 1/1998 |
| DE | 102006023831 | A1 | 11/2007 |
| EP | 0819638 | A2 | 1/1998 |

(Continued)

OTHER PUBLICATIONS

International Search Report for PCT/FI2010/050122, 2010.

(Continued)

*Primary Examiner* — Mark Halpern
(74) *Attorney, Agent, or Firm* — Stiennon & Stiennon

(57) ABSTRACT

A roll assembly (10) for a fiber-web machine has at least at one end thereof, with a bearing assembly (20) with a bearing housing, which bearing housing (18) has a flexible and attenuating attachment arrangement by means of which the roll can be attached in a flexible and attenuating manner on the frame or foundation (22) of the fiber-web machine. A mass absorber (24) is arranged in conjunction with the bearing housing, whereby the damping of the vibration of the roll assembly is arranged by the cooperation of the bearing housing that is attached in a flexible and attenuating manner and the mass absorber (24) in conjunction therewith. The invention also relates to a method of attenuating the vibration of a roll of a fiber-web machine.

5 Claims, 2 Drawing Sheets

FOREIGN PATENT DOCUMENTS

| | | | |
|---|---|---|---|
| FI | 94458 | | 5/1995 |
| FI | 101320 | B | 5/1998 |
| FI | 118482 | B | 11/2007 |
| FI | 118741 | B | 2/2008 |
| WO | 9849394 | A1 | 11/1998 |
| WO | 0004227 | A1 | 1/2000 |
| WO | 0004228 | A1 | 1/2000 |
| WO | 2007144466 | A1 | 12/2007 |
| WO | 2008003820 | A2 | 1/2008 |
| WO | 2009153401 | A1 | 12/2009 |
| WO | 2010106219 | A1 | 9/2010 |

OTHER PUBLICATIONS

International Preliminary Report on Patentability for PCT/FI2010/050122, 2010.

Finnish Search Report for FI 20095277, 2009.

* cited by examiner

ROLL ASSEMBLY FOR A FIBER-WEB MACHINE AND METHOD OF ATTENUATING VIBRATION OF A FIBER-WEB MACHINE ROLL

CROSS REFERENCES TO RELATED APPLICATIONS

This application is a U.S. national stage application of International Application No. PCT/FI2010/050122, filed Feb. 23, 2010, the disclosure of which is incorporated by reference herein, and claims priority on Finnish App. No. 20095277, filed Mar. 18, 2009.

STATEMENT AS TO RIGHTS TO INVENTIONS MADE UNDER FEDERALLY SPONSORED RESEARCH AND DEVELOPMENT

Not applicable

BACKGROUND OF THE INVENTION

The present invention relates to a roll assembly for a fiber-web having at least at one end thereof a bearing assembly with a bearing housing, which bearing housing comprises a flexible and attenuating attachment arrangement, by means of which the roll can be attached in a flexible and attenuating manner on the frame or foundation of the fiber-web machine. The invention also relates to a method of attenuating the vibration of a fiber-web machine roll, in which method the roll is rotatably attached at its ends on a bearing assembly in bearing housings, which bearing housings are supported in a flexible and attenuating manner on the frame or foundation of the fiber-web machine.

Along with the increasing widths and higher speeds of fiber-web machines, the vibration of rolls is becoming an ever-increasing problem. The rolls in fiber-web machines are used, for instance, to guide the travel of the web and/or support fabric. As for the properties of the fibrous web, such operative positions of the rolls, in which the roll is involved in the processing of the web, such as roll nips, calender rolls, counter rolls for coating and winding drums or reeling drums are, however, the more essential. Especially, the winding drums and drums of slitter-winders used for web finishing are challenging objects in terms of vibration, since the winding of customer reels of different sizes and possibly containing various kinds of flaws will easily get disturbed due to excessive vibration. Traditionally, the rolls are attached onto foundations as rigidly as possible, especially when the drums of a slitter-winder are concerned.

Vibration is a problem particularly in two-drum or belt-type winders. A vibration problem occurring with drum winders arises when the harmonics of the rotational speed of a paper roll produced on drums excites the natural frequencies of the drums. The same type of a vibration problem occurs also with the reeling drums of reel-ups. The resonance vibrations during the operation of a machine or a device are often caused by insufficient damping, i.e. inadequate dynamic stiffness at the resonance frequency. It is often possible to improve the situation by directly modifying the resonating structure in order to increase its damping.

Publications WO9849394, WO0004227 and WO0004228 disclose solutions, in which an adjustable mass absorber is arranged in the bearing housing of a paper machine roll. In the solution according to the publications, the adjustability of the frequency of the vibration to be absorbed is realized by changing the position of the mass on a vibrating rod or alternatively, by changing the magnitude of the mass. Since the absorber is relatively easy to access, the tuning can be changed even during the operation of the machine. However, this kind of a solution is not always capable of providing sufficient attenuation of vibration. To provide efficient attenuation of vibration the vibrating mass should be very large, which is not advantageous e.g. in view of space utilization and also due to the solid support structures, which are then required.

F1 patent 94458 discloses a method and an apparatus for controlling the vibrations of paper machine rolls. According to the method, the locations of critical speed areas are changed during the operation. The critical speed is changed by adjusting the mass and/or the stiffness of the roll, and/or the attachment point of the roll. Amending the stiffness of the bearing assembly at the ends of the roll is suggested as an alternative. Intermediate pieces of elastic material may be placed between the base plate of the bearing housings of the end bearings and the frame. The stiffness of the attachment of the bearing housings can be adjusted by adjusting the force, by which the bearing housing presses the intermediate pieces against the frame. Said pressing force can be adjusted by means of a cylinder device or a screw.

JP patent publication 3082843 discloses an arrangement for attenuating vibrations of a roll. The drive motor of the roll is flexibly attached to the frame. The attachment includes a vibration-proof intermediate piece of rubber between the bottom plate of the securing part of the drive motor and the frame. The securing bolts of the bottom plate extend through the frame plate to a cylinder attached to the bottom surface of the frame plate, where they are secured to a piston in the cylinder. There are rubber sleeves under the heads of the securing bolts, whereby the attachment of the bottom plate is made floating. The inner surface of the cylinder is provided with an extension, which limits the movement of the piston upwards in the cylinder. There is a spring between the cylinder top and the upper surface of the piston, and a pressure space with pressurized air as the pressure medium between the bottom surface of the piston and the bottom of the cylinder. At first, the piston is taken pneumatically against the extension of the inner surface of the cylinder, whereby the intermediate rubber pieces and the sleeves are subjected to a minimum compression force. As soon as the pressure of the compressed air under the piston is decreased, the piston moves downwards by the force of the spring above the piston, whereby a larger compression force is exerted on the intermediate rubber pieces and the rubber sleeves. Thus, the stiffness of the roll attachment can be regulated by the pressure of the pressure medium under the piston.

F1 patent No. 118482 discloses a roll attachment in a paper or board machine, where the roll is rotatably attached at its ends on bearings in bearing housings, which bearing housings are supported on the frame or foundation of the machine by means of elastic intermediate pieces. In the publication, a specific advantageous range of variation is given to the spring constant of the intermediate pieces. In this arrangement, the damping capacity of a weakly dampened flexible structure is increased by changing the boundary conditions for the structure so that damping is introduced into the structure to be dampened through its attachment. Then, the static stiffness of the structure and its attachment is decreased, but the dynamic stiffness of the structure itself increases. Although the solution as such is advantageous and efficient, there has lately arisen a need to further improve the damping efficiency in order to provide enhanced vibration damping properties.

Slender rolls, in particular, bend more at their lowest natural frequency than the short and thick rolls. Thus, the relative movement between the bearing housing and the roll center is smaller with slender rolls. This weakens the efficiency of the damping solution according to F1 patent 118482 especially for slender rolls. The lowest natural frequency of slender rolls is even with a fixed bearing housing fairly close to the maximum natural frequency of the roll. Hereby, the optimum flexibility of the solution according to F1 118482 cannot necessarily be utilized, as the natural frequency of the roll may drop very close to the maximum rotational frequency of the roll.

SUMMARY OF THE INVENTION

The particular purpose of the present invention is to raise the level of technology from prior art by providing such a roll assembly for a fiber-web machine, by which the roll vibrations can be affected more efficiently than before. A special purpose of the invention is to provide a method of attenuating the vibration of slender rolls.

The roll assembly for a fiber-web machine according to the invention comprises at its both ends a bearing assembly with a bearing housing, which bearing housing comprises a flexible and attenuating attachment arrangement by means of which the roll can be attached in a flexible and attenuating manner on the frame or foundation of the fiber-web machine, and a mass absorber which is arranged in conjunction with the bearing housing, whereby the damping of the vibration of the roll assembly is arranged by the cooperation of the bearing housing that is attached in a flexible and attenuating manner and the mass absorber in conjunction therewith. The roll assembly is mainly characterized in that the ratio of the shell length of the roll to the diameter thereof is at least seven, and that the bearing housing is arranged on the frame or foundation of the fiber-web machine to vibrate at an amplitude of the bearing housing movement which is ≧10% of the amplitude of the movement of the roll center at the eigenmode corresponding to the lowest bending eigenfrequency of the roll.

According to one embodiment, the spring constant of the flexible and attenuating attachment arrangement of the bearing housing is 0.04 GN/m-1 GN/m. Preferably, the attachment arrangement comprises intermediate pieces to be placed between the attachment lugs of the bearing housings and the frame or foundation of the fiber-web machine. According to one embodiment of the invention, the loss factor of the flexible and attenuating attachment arrangement of the bearing housing is $0.01<\eta<2$.

Preferably, the roll is a slender roll. In this context a slender roll refers to such a roll, the shell length of which is at least seven times the diameter of the roll shell. According to one preferable embodiment of the invention, the roll assembly for a fiber-web machine comprises at its both ends a bearing assembly, the bearing housing of which comprises a flexible and attenuating attachment arrangement.

Such a flexible and attenuating attachment of the bearing housing creates prerequisites for efficient operation of the mass absorber. In addition, the overall effect is improved even if the stiffness of the bearing housing attachment is decreased. In other words, by bringing the bearing housing to vibrate with a larger vibratory motion range by arranging its attachment more flexible than before, a stronger excitation is created for the mass absorber and thereby more efficient overall operation is provided.

The roll assembly for a fiber-web machine according to one embodiment of the invention comprises a roll, the ratio of the shell length of which roll to the diameter thereof is at least 7, and both ends of which roll are provided with a bearing assembly with a bearing housing. The bearing housing comprises a flexible and attenuating attachment arrangement, by means of which the roll can be attached in a flexible and attenuating manner on the frame or foundation of the fiber-web machine so that the bearing housing is arranged to vibrate at the amplitude of the bearing housing movement, which is ≧10% of the amplitude of the movement of the roll center at the eigenmode corresponding to the lowest bending eigenfrequency of the roll.

A mass absorber is arranged in conjunction with the bearing housing, whereby the damping of the vibration of the roll assembly is arranged by the cooperation of the bearing housing that is attached in a flexible and attenuating manner and the mass absorber in conjunction therewith.

According to one embodiment of the invention, the fiber-web machine roll is a reeling drum of a reel-up for a web reel, such as a winding drum of a machine winder or a single-drum winder. According to another embodiment of the invention, the fiber-web machine roll is a drum in the winding section of a two-drum winder. Preferably, the mass of the mass absorber is ≦5% of the roll mass.

In the method according to the invention of attenuating the vibration of a fiber-web machine roll, the roll is rotatably attached at its ends on a bearing assembly in bearing housings and the bearing housings are supported in a flexible and attenuating manner on the frame or foundation of the fiber-web machine.

A mass absorber is arranged in conjunction with the flexible and attenuating bearing housing attachment, whereby vibration is damped by the cooperation of the bearing housing that is attached in a flexible and attenuating manner and the mass absorber in conjunction therewith. The method is mainly characterized in that the ratio of the shell length of the roll to the diameter thereof is arranged to be at least seven, and that the bearing housing is supported on the frame or foundation of the fiber-web machine so that the vibration amplitude of the bearing housing movement is ≧10% of the amplitude of the movement of the roll center at the eigenmode corresponding to the lowest bending eigenfrequency of the roll.

In the method, due to the flexible attachment of the bearing housing of the roll, the relative movement of the bearing housing with respect to the roll body is increased at the lowest bending eigenfrequency, whereby the efficiency of the mass absorber is improved. In this context, the efficiency of the mass absorber is to be understood as the ratio between the reduction of the maximum value of the amplitude of the frequency response function of the lowest bending eigenfrequency and the mass of the mass absorber, measured at the roll center.

By the method of this kind, the vibrations of a rotating roll can be damped very efficiently. The advantages of the invention are most obvious in case of a slender roll. In this context, a slender roll refers to such a roll, the shell length of which is at least seven times the diameter of the roll shell.

According to one embodiment of the invention, the bearing housing is attached so that its flexibility is such that the amplitude of the movement of the bearing housing is ≧10% of the amplitude of the movement of the roll center at the eigenmode corresponding the lowest bending eigenfrequency of the roll.

Preferably, the flexibility of the bearing housing is adapted so that the amplitude of the bearing housing movement is 10%-20% of the amplitude of the movement of the roll center at the eigenmode corresponding the lowest bending eigenfrequency of the roll.

According to one embodiment of the invention, the bearing housing is supported flexibly on the frame or foundation of the fiber-web machine by means of flexible and attenuating intermediate pieces. Then, the spring constant of the intermediate pieces is preferably 0.04 GN/m-1 GN/m and the loss factor 0.01<η21 2.

According to another embodiment of the invention, the lower limit of the spring constant of the intermediate pieces is determined by the prerequisite that the critical speed of the roll is higher than the maximum rotational frequency of the roll. Preferably, the critical speed of the roll is at least 10% higher than the maximum rotational frequency of the roll.

According to one embodiment, the operation of the mass absorber is tuned during the operation of the fiber-web machine. Then, it is advantageous to set the natural frequency of the mass absorber itself to follow a desired excitation frequency. Especially when applying the invention to a roll of a reel-up of a slitter-winder, the natural frequency of the mass absorber is set to follow the excitation frequency of the web roll/rolls to be wound.

According to another embodiment, the mass absorber operates at a constant frequency.

According to one embodiment of the invention, the reeling drum or the drum of the winding section of a slitter-winder for un-coated fine paper comprises a roll assembly according to the invention.

One embodiment of the invention relates to a roll assembly comprising a roll, both ends of which roll are provided with a bearing assembly with a bearing housing, which bearing housing comprises a flexible and attenuating attachment arrangement, by means of which the roll can be attached in a flexible and attenuating manner on the frame or foundation of a fiber-web machine so that a mass absorber is arranged in conjunction with the bearing housing to be used as a reeling drum/drum o for the slitter-winder for a fibrous web.

Other embodiments of the invention are shown in the appended claims and in the disclosure of the drawings. In the following, the invention and its operation will be explained with reference to the appended schematic drawings

DESCRIPTION OF THE PREFERRED EMBODIMENTS

Figure 1:
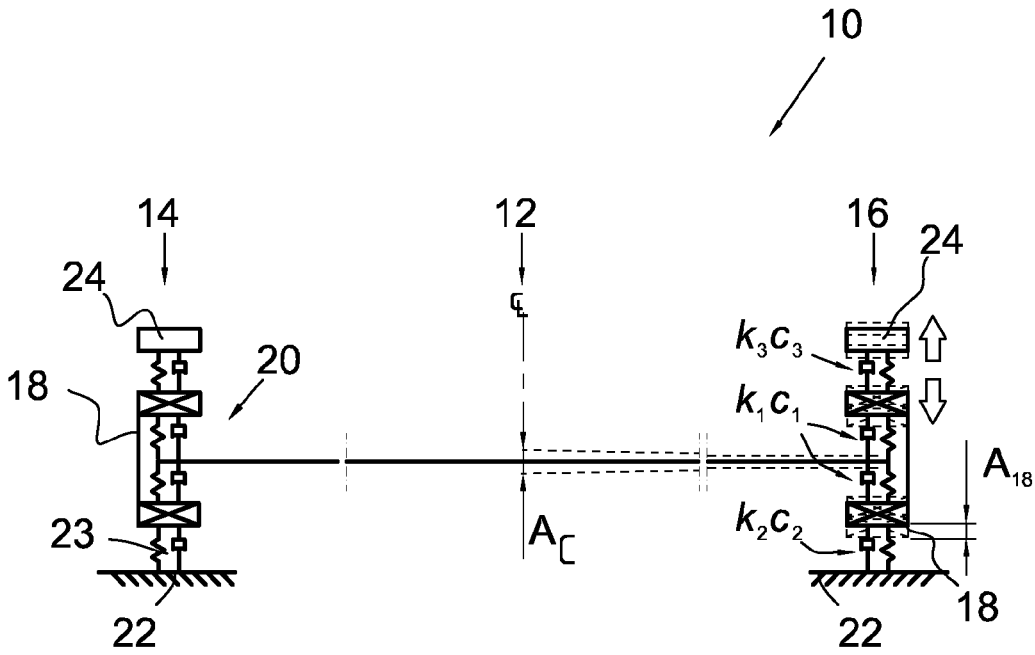
FIG. 1 is a schematic view of a slender roll according to one embodiment.

FIG. 1 shows schematically a roll assembly 10 for a fiber-web machine according to one embodiment of the invention. In the figure, the roll of the roll assembly is cut in the longitudinal direction (in the cross-direction of the fiber-web machine) at two points, whereby the central area 12 of the roll and the first and second end 14, 16 thereof are shown herein. Further, the vibration of the roll assembly during operation is illustrated on the right side in the figure. The roll is a so-called slender roll, the length of which is at least seven times the diameter of the roll shell. The roll is rotatably attached at its ends by means of bearing assemblies 20. The roll is attached on the bearing assembly 20 in the bearing housings 18 located at its both ends.

The flexibility of the bearing assembly is indicated by the spring constant $k_1$ and the attenuation by the attenuation constant $c_1$. Here, the attenuation is described by way of example as viscous damping, but the attenuation is not limited to viscous damping only. As to the bearing housings 18, they are supported on the frame or foundation 22 of the fiber-web machine. The attachment of the bearing housings is realized in a flexible and attenuating manner, whereby the bearing housing is arranged to move in an attenuated manner with respect to the frame or foundation 22, while the roll is vibrating. The bearing housing is preferably supported on the frame or foundation 22 of the fiber-web machine by means of an intermediate piece 23. Here, the intermediate piece is indicated by the symbols of flexibility and attenuation. The flexibility is here indicated by the spring constant $k_2$ and the attenuation by the attenuation constant $c_2$. According to the invention, a mass absorber 24 is arranged in conjunction with the bearing housing of the roll assembly. The mass absorber is a mass attached in a flexible and attenuating manner to the bearing housing, which mass is arranged to dampen the roll vibration, when adequately tuned. The flexibility of the mass absorber with respect to the bearing housing is indicated by the spring constant $k_3$ and the attenuation by the attenuation constant $c_3$. Thus, the roll vibration is attenuated by arranging the mass absorber 24 in conjunction with the bearing housing 18 that is attached in a flexible and attenuating manner $k_2$, $c_2$. In this way the vibration is damped by the cooperation of the bearing housing that is attached in a flexible and attenuating manner and the mass absorber in conjunction therewith, whereby especially the damping of the vibration of a slender roll is efficient.

The mass absorber 24 in the embodiment according to FIG. 1 is a combination of a spring and a mass, where the mass is attached to the bearing housing 18 via the spring $k_3$, $c_3$. The bearing housing is supported on the frame or foundation 22 of the fiber-web machine in a flexible and attenuating manner so that the magnitude of amplitude $A_{18}$ of the vibratory motion of the bearing housing is such that favorable conditions are created for the operation of the mass absorber 24. In practice this means that the flexible and attenuating support allows a sufficiently large movement for the bearing housing, when the roll is in operation. This movement creates prerequisites for efficient operation of the mass absorber and improves the overall damping of the vibration of the roll assembly. A bearing housing that is supported on the frame too stiffly does not give sufficient excitation to the mass absorber in terms of its operation. The spring constant $k_2$ of the flexibility of the bearing housing is 0.04 GN/m-1 GN/m.

In this manner, the impact of the mass absorber on the damping of vibration is made more efficient and the operation of the mass absorber is efficient with a relatively small mass of the mass absorber. Preferably, the mass of the mass absorber is <5% of the mass of the roll. In the vibratory motion of the bearing housing the amplitude $A_{18}$ is preferably arranged to be ≧10% of the amplitude $A_c$ of the movement of the roll center, whereby the mass absorber 24 is made to operate according to the invention.

Preferably, the flexibility of the bearing housing is arranged so that the amplitude of the movement of the bearing housing is 10%-20% of the amplitude of the movement of the roll center.

Figure 2:
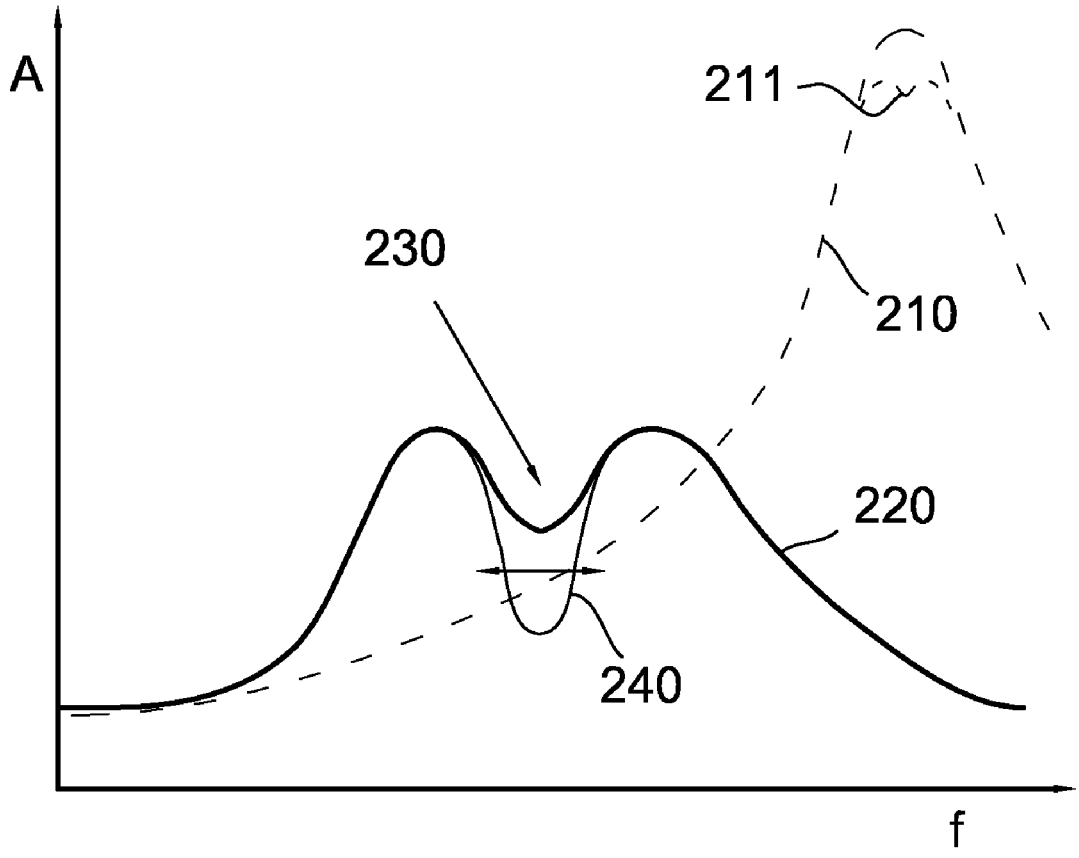
FIG. 2 shows schematically the amplitude of the frequency response illustrating the operation of the invention.

FIG. 2 illustrates the operation of the invention by means of the amplitude A of the frequency response f of the vibration of a slender roll. In the figure, the behavior of a slender roll without applying the method and arrangement according to the invention is shown by a dashed line 210 and the behavior of the roll when utilizing the invention is shown by a solid line 220. When the roll is provided with nothing but a mass absorber, only a small section of the amplitude can be cut off, as shown by the curve 211. This is due to the fact that, in the case of a slender roll, in a normal stiff bearing housing attachment the housing is practically immobile at the lowest bending eigenfrequency of the roll compared to the movement of the roll center.

When sufficient flexibility of the bearing housing (and the amplitude of its vibration) is arranged at the same time and the additional affect of the mass absorber is combined therewith, a conspicuous decrease in the vibration is obtained in a situation with sufficient flexibility of the bearing housing. This is illustrated by the curve 220. As soon as the flexibility of the bearing housing attachment is sufficiently high, the mass of the mass absorber can be relatively small. By the solution according to the invention, excellent damping properties can be achieved for a mass that is only <5% of the mass of the roll.

According to one embodiment of the invention, the operation of the mass absorber is tuned during the operation of the fiber-web machine. The position of the lower bend 230 in FIG. 2 is determined by the equation $$F=1/2\pi\sqrt{(k_3/\mathrm{m})}$$

where $k_3$ is the spring constant of the mass absorber and m is the vibrating mass of the mass absorber. The tunability during operation can be realized for instance by an adjustable mass m or by an adjustable spring constant $k_3$. Then, the position of the lower bend 230 can be adjusted to follow the most significant excitation frequency. When the roll is a winding drum of a slitter-winder for a fibrous web, it is advantageous to make the adjustment comply with the excitation of the most significant customer roll, i.e. follow its excitation frequency. In adaptive damping, where the operation of the mass absorber is tuned during the operation of the fiber-web machine, it is advantageous to arrange the damping of the mass absorber small, as shown by the curve 240 in FIG. 2. Then, the lower bend 230 is particularly deep indicating an especially good vibration damping ability within a relatively narrow, but tunable frequency range.

It is to be noted that only a few most advantageous embodiments of the invention are described in the above. Thus, it is clear that the invention is not limited to the above-described embodiments, but may be applied in many ways within the frame of the appended claims. The features described in conjunction with the different embodiments may be used in conjunction with other embodiments as well and/or various combinations of the described features may be made within the frame of the basic idea of the invention, if so desired, and if technical feasibility for this exists.

The invention claimed is:

1. A method of attenuating the vibration of a roll of a fiber-web machine, the roll having a center, a shell defining a length and a diameter, and having a ratio of shell length to diameter of at least seven, and wherein said roll has a lowest bending eigenfrequency, the method comprising the steps of:

rotating the roll between two bearing housings, each bearing housing forming part of a bearing assembly, each bearing housing being attached at an end of the roll;

wherein the rotation of the roll results in vibration of the roll, the vibration of the roll center defining an amplitude of movement of the roll center;

mounting a mass absorber having a selected natural frequency to each bearing housing;

mounting the bearing housings to a frame or a foundation of the fiber-web machine so that each bearing housing is supported on the frame or the foundation with a selected spring constant and a selected loss factor $\eta$ so that the bearing housing vibrates with an amplitude of at least 10% of the amplitude of the movement of the roll center at an eigenmode corresponding to the lowest bending eigenfrequency of the roll.

2. The method of claim 1 wherein the selected spring constant and the selected loss factor $\eta$ are selected to allow movement of the bearing housings, such that prerequisites for efficient damping are created for the mass absorber in conjunction with the bearing housing.

3. The method of claim 1 further comprising tuning the operation of the mass absorbers during the operation of the fiber-web machine.

4. The method of claim 3 wherein the natural frequency of the mass absorber is tuned to follow a selected excitation frequency.

5. The method of claim 1 further comprising the steps of:

mounting each bearing housing with a selected spring constant in the range of 0.04 GN/m-1 GN/m and a selected loss factor $\eta$ in the range $0.01<\eta<2$ on the frame or foundation of a slitter winder;

mounting the mass absorber on each bearing housing, such that damping of vibration of the roll assembly is produced by a cooperative interaction of the mass absorbers and the bearing housings;

operating the winding section of a slitter-winder so the roll rotates and vibrates at the eigenmode corresponding to the lowest bending eigenfrequency of the roll, producing the amplitude of movement of the roll center.

* * * * *

UNITED STATES PATENT AND TRADEMARK OFFICE

CERTIFICATE OF CORRECTION

PATENT NO. : 8,372,245 B2
APPLICATION NO. : 13/257202
DATED : February 12, 2013
INVENTOR(S) : Marko Jorkama It is certified that error appears in the above-identified patent and that said Letters Patent is hereby corrected as shown below:

Column 5, line 4, "0.01 <η21 2" should be -- 0.01<η<2 --.

Column 5, line 33, "drum/drum o for the slitter winder" should be
-- drum/drum for the slitter winder --.

Signed and Sealed this
Nineteenth Day of March, 2013

Teresa Stanek Rea
*Acting Director of the United States Patent and Trademark Office*